United States Patent [19]

Hughes

[11] 3,940,809

[45] Mar. 2, 1976

[54] SWIMMING POOL COVER

[75] Inventor: George A. Hughes, Oakville, Canada

[73] Assignee: The Raymond Lee Organization, Inc., a part interest

[22] Filed: Aug. 26, 1974

[21] Appl. No.: 500,336

[52] U.S. Cl. ..... 4/172.12

[51] Int. Cl.[2] ..... E04H 3/19

[58] Field of Search..... 4/172.12, 172.13, 172.14

[56] References Cited

UNITED STATES PATENTS

| | | | |
|---|---|---|---|
| 2,870,455 | 1/1959 | Reeves | 4/172.12 |
| 2,883,676 | 4/1959 | Kwake | 4/172.12 |
| 3,555,573 | 1/1971 | Turner | 4/172.12 |
| 3,747,131 | 7/1973 | Koliomichalis | 4/172.12 |

*Primary Examiner*—Houston S. Bell, Jr.

[57] ABSTRACT

A hollow air filled flexible horizontal endless plastic waterproof loop floats on top of the water in a swimming pool and is shaped to conform with and bear continuously against the inner periphery of the pool. The loop has an open central region. A thin flat flexible horizontal plastic waterproof sheet is disposed in the region to close same and is sealed at its periphery to the loop.

3 Claims, 5 Drawing Figures

SWIMMING POOL COVER

SUMMARY OF THE INVENTION

Water in a swimming pool will evaporate whereby the remaining water will be cooled even when exposed to the hot sun.

The invention explained herein is a cover which is readily packed into a small space when not in use and when in use prevents loss of heat by evaporation. This cover floats on the surface of the water when the pool is not in use and prevents evaporation and resultant heat loss. The cover takes the form of a plastic hollow air filled horizontal endless loop having an open central region and shaped to conform with and bear continuously against the inner periphery of the pool. A thin flat flexible horizontal sheet of plastic is disposed in the region to close same and is sealed at its periphery to the loop. The sheet can be dark colored to pass to heat of the sun more readily into the water. Since the sheet and loop are both waterproof and cover substantially the entire exposed surface of the water, evaporation cannot occur and heat loss produced thereby is avoided.

DETAILED DESCRIPTION OF PREFERRED EMBODIMENTS

Referring now to FIGS. 1–4, a swimming pool 10 which can be circular, rectangular, square or kidney shaped, or indeed having other shapes as well, contains water 12.

An elongated hollow air filled flexible loop 14 formed of circular plastic tubing and adapted to float on water in sized and contoured to bear continuously against the inner periphery of the pool. This loop has a large central opening.

Figure 1:
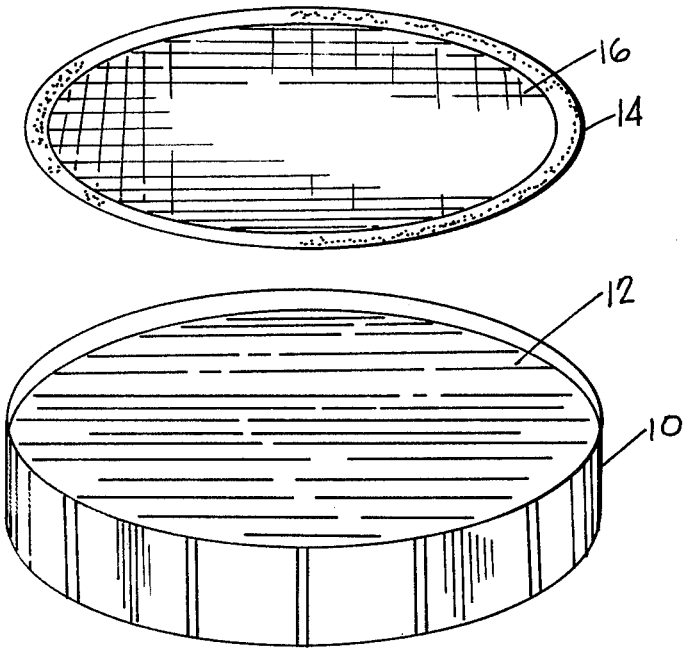
FIG. 1 is a perspective exploded view of the invention in use.
Figure 2:
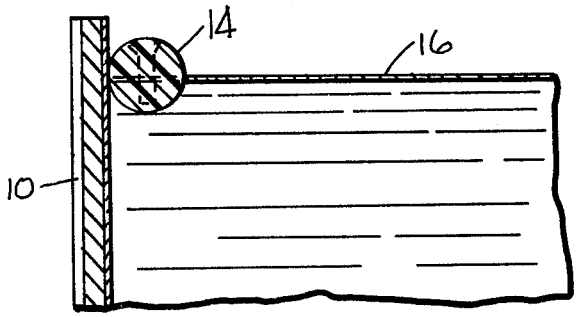
FIG. 2 is a detail side view thereof.
Figure 3:
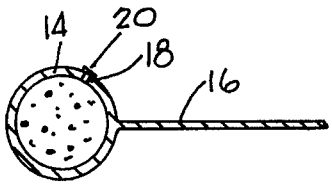
FIG. 3 is an enlarged detail view of a portion of the structure shown in FIG. 2.
Figure 5:
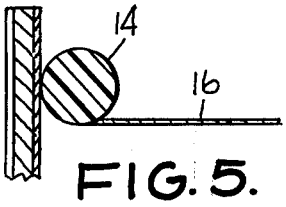
FIG. 5 is a view similar to FIG. 2 but showing a modification thereof.
Figure 4:
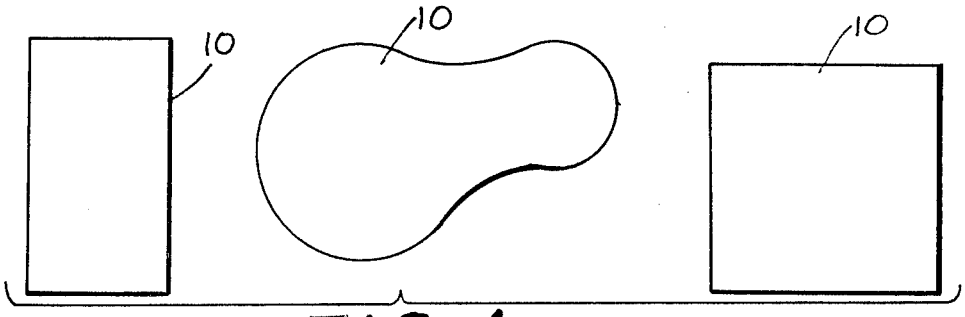
FIG. 4 illustrates various shapes of swimming pools.

A thin flat horizontal flexible plastic sheet 16 which also can float on water closes the central opening and is sealed at its periphery to the loop 14. The sheet can be dark colored to provide enhanced absorption of heat from the sun. The sheet if extended through the loop would in vertical cross section define a horizontal diameter thereof. Alternatively, the sheet could be disposed tangent to the bottom of the loop as shown in FIG. 5.

Both sheet and loop are waterproof. To permit the structure to be easily collapsed for storage or erected for use, the loop can be inflated with air or deflated via opening 18 filled by removable plug 20.

While the invention has been described with detailed reference to the drawings, the protection sought is to be limited only by the terms of the claims which follow.

I claim:

1. In combination with a swimming pool containing water to a preselected level and having an inner periphery:

a hollow air filled flexible waterproof endless loop shaped to conform to said periphery and floating on top of the water, the loop having an open central region and bearing continuously against the periphery, said loop in vertical cross section defining a circle and having a peripheral opening closed by a removable plug whereby the loop can be inflated for use and deflated for storage; and a thin flat flexible horizontal dark colored plastic waterproof sheet closing said region and sealed at its periphery to said loop, said sheet being adapted to float in water.

2. The combination of claim 1 wherein said sheet is secured to the periphery of the loop and in extension is coincident with a horizontal diameter traversing the interior of the loop.

3. The combination of claim 1 wherein the sheet is secured to the periphery of the loop and in extension is tangent to the bottom of the loop.

* * * * *